US008287239B2

(12) United States Patent
Dimelow

(10) Patent No.: US 8,287,239 B2
(45) Date of Patent: Oct. 16, 2012

(54) ANNULUS FILLER

(75) Inventor: Stephen Jonathan Dimelow, Staffordshire (GB)

(73) Assignee: Rolls-Royce PLC (GB)

( * ) Notice: Subject to any disclaimer, the term of this patent is extended or adjusted under 35 U.S.C. 154(b) by 657 days.

(21) Appl. No.: 12/393,091

(22) Filed: Feb. 26, 2009

(65) Prior Publication Data

US 2009/0226318 A1 Sep. 10, 2009

(30) Foreign Application Priority Data

Mar. 7, 2008 (GB) ..... 0804260.8

(51) Int. Cl.
*F01D 5/30* (2006.01)

(52) U.S. Cl. ..... 416/193 A; 416/196 R; 416/219 R; 416/220 R; 416/248

(58) Field of Classification Search ..... 416/193 A, 416/196 R, 219 R, 220 R, 248
See application file for complete search history.

(56) References Cited

U.S. PATENT DOCUMENTS 5,131,814 A * 7/1992 Przytulski et al. ..... 416/217
2005/0129522 A1 6/2005 Kite et al.

FOREIGN PATENT DOCUMENTS

EP 1881160 A2 1/2008
EP 2090749 A2 8/2009
EP 2108786 A2 10/2009
FR 1341910 A 9/1963
GB 1331209 9/1973
GB 2171151 A 8/1986

* cited by examiner

*Primary Examiner* — Robert Pascal
*Assistant Examiner* — Kimberly Glenn
(74) *Attorney, Agent, or Firm* — McCormick, Paulding & Huber LLP

(57) ABSTRACT

An annulus filler is provided for mounting to a rotor disc of a gas turbine engine and for bridging the gap between two adjacent blades attached to the rotor disc. The annulus filler defines an airflow surface for air being drawn through the engine. The annulus filler has one or more primary connectors for connecting the annulus filler to the rotor disc, and for resisting, in use, centrifugal forces on the annulus filler. Each primary connector allows rotation of the annulus filler around the center line of the engine relative to the rotor disc at that primary connector. The annulus filler also has a secondary connector for connecting the annulus filler to the rotor disc and for resisting, in use, motion of the annulus filler relative to the rotor disc in a first axial direction. The secondary connector allows rotation of the annulus filler around the center line of the engine relative to the rotor disc at the secondary connector.

11 Claims, 7 Drawing Sheets

ANNULUS FILLER

CROSS REFERENCE TO RELATED APPLICATION

This application is entitled to the benefit of British Patent Application No. GB 0804260.8, filed on Mar. 7, 2008.

FIELD OF THE INVENTION

The present invention relates to annulus fillers for bridging gaps between adjacent blades of a gas turbine engine stage.

BACKGROUND OF THE INVENTION

Conventionally, a compressor rotor stage in a gas turbine engine comprises a plurality of radially extending blades mounted on a disc. The blades are mounted on the disc by inserting a root portion of the blade in a complementary retention groove in the outer face of the disc periphery. To ensure a smooth radially inner surface for air to flow over as it passes through the stage, annulus fillers can be used to bridge the spaces between adjacent blades. Typically, a seal between the annulus fillers and the adjacent fan blades is also provided by resilient strips bonded to the annulus fillers adjacent the fan blades.

Annulus fillers of this type are commonly used in the fan stage of gas turbine engines. The fillers may be manufactured from relatively lightweight materials and, in the event of damage, may be replaced independently of the blades.

It is known to provide annulus fillers with features for removably attaching them to the rotor disc. An annulus filler may be provided with axially spaced hook members, the hook members sliding into engagement with respective parts of the rotor disc and/or a component located axially behind the rotor assembly, for example a rear fan air seal. FIG. 1 shows an example of such an annulus filler viewed from the side. In use, the upper surface or lid 2 of the annulus filler 1 bridges the gap between two adjacent fan blades (not shown) and defines the inner wall of the flow annulus of a fan stage. The annulus filler 1 is mounted on a fan disc (not shown) by two hook members 3 and 4, respectively towards the forward and rearward ends of the annulus filler. It is also attached to a front support ring (not shown) at axial retention flange 5, the support ring itself attaching to the front of the fan disc. The two opposed side faces of the annulus filler are provided with respective seal strips (not shown) and confront the aerofoil surfaces of the adjacent fan blades. Typically the annulus filler is a machined aluminium alloy forging.

Retention flange 5 carries an interference fit pin 6 which inserts into a corresponding hole formed in the front support ring. Flange 5, abutting the support ring, resists motion of the annulus filler in the forward axial direction, while pin 6 helps to ensure that the annulus filler occupies the correct angular position on the disc.

Annulus fillers of this type are self-loading in that, as a rotating component, the majority of forces on the filler are generated by its own mass. However, under birdstrike or blade-off conditions, a blade can deflect at the annulus filler position and apply a pushing force to the filler in a lateral, circumferential direction. The hook contact faces of the annulus filler shown in FIG. 1 and of the fan disc to which, in use, it is mounted are curved around a radius of the disc so that under the force of a deflecting blade the filler will tend to rotate at the hook members around the centre line of the engine.

However, as the axial retention flange 5 is pinned, and sometimes also bolted, to the front support ring, this rotation leads to twisting of the annulus filler. The twisting can cause damage or failure of the filler, typically at the lid 2 between the forward hook member and the retention flange.

SUMMARY OF THE INVENTION

An object of the invention is to provide an annulus filler which is less likely to sustain damage under lateral loading from an adjacent blade.

A first aspect of the present invention provides an annulus filler for mounting to a rotor disc of a gas turbine engine and for bridging the gap between two adjacent blades attached to the rotor disc, the annulus filler defining an airflow surface for air being drawn through the engine, wherein the annulus filler has one or more primary connectors for connecting the annulus filler to the rotor disc, and for resisting, in use, centrifugal forces on the annulus filler, the or each primary connector allowing rotation of the annulus filler around the centre line of the engine relative to the rotor disc at that primary connector; and a secondary connector for connecting the annulus filler to the rotor disc and for resisting, in use, motion of the annulus filler relative to the rotor disc in a first axial direction, the secondary connector allowing rotation of the annulus filler around the centre line of the engine relative to the rotor disc at the secondary connector.

Thus, by having a secondary connector that allows rotation of the annulus filler around the centre line at the secondary connector, it is possible to eliminate or reduce twisting of the filler under lateral loading from an adjacent blade. Eliminating or reducing such twisting in turn can reduce the amount of damage sustained by the filler.

Preferably, the or each primary connector is configured to allow circumferential sliding motion of the annulus filler relative to the rotor disc at that primary connector.

The or each primary connector may include a hook extending radially inwards for engagement with a correspondingly-shaped hook on the radially outer face of the rotor disc. The hook contact faces can be curved around a radius of the engine.

Preferably, the or each primary connector resists, in use, motion of the annulus filler relative to the rotor disc in the opposite axial direction to the first axial direction. However, motion of the annulus filler in the first axial direction may not be resisted by the or each primary connector. For example, when the primary connector includes a rearward-facing hook, the hook can resist motion of the annulus filler relative to the rotor disc in the rearward axial direction, but not in the forward axial direction.

Preferably, the secondary connector is configured to allow circumferential sliding motion of the annulus filler relative to the rotor disc at the secondary connector.

The secondary connector may be formed at an axial end of the annulus filler, and preferably, for ease of access, it is formed at the axial end corresponding to the side of the rotor disc from which an operator mounts the filler. For example, fan disc annulus fillers are generally inserted into position from the forward side of the fan disc, whereby, for such a disc, the secondary connector is conveniently formed at the axially forward end of the filler.

Preferably, the secondary connector comprises a pin and slot coupling, the slot extending in a circumferential direction, and the pin extending through the slot in an axial direction and being movable along the slot to allow rotation of the filler around the engine centre line at the secondary connector.

The secondary connector may be configured to allow the rotation at the secondary connector only within predetermined limits. For example, when the secondary connector comprises a pin and slot coupling, the predetermined limits may be defined by the ends of the slot, which prevent further movement of the pin in the direction of the slot.

The slot of the pin and slot coupling may be formed in the annulus filler. For example in a retention flange extending from the filler.

The pin may be provided by the shaft of a fixing bolt which, in use, resists the motion of the annulus filler relative to the rotor disc in the first axial direction.

Typically, the annulus filler bridges the gap between adjacent fan blades.

A further aspect of the present invention provides a stage for a gas turbine engine having a rotor disc, a plurality of circumferentially spaced apart blades attached to the rotor disc, and a plurality of annulus fillers according to the first aspect bridging the gaps between adjacent blades.

DETAILED DESCRIPTION OF THE PREFERRED EMBODIMENTS

Figure 1:
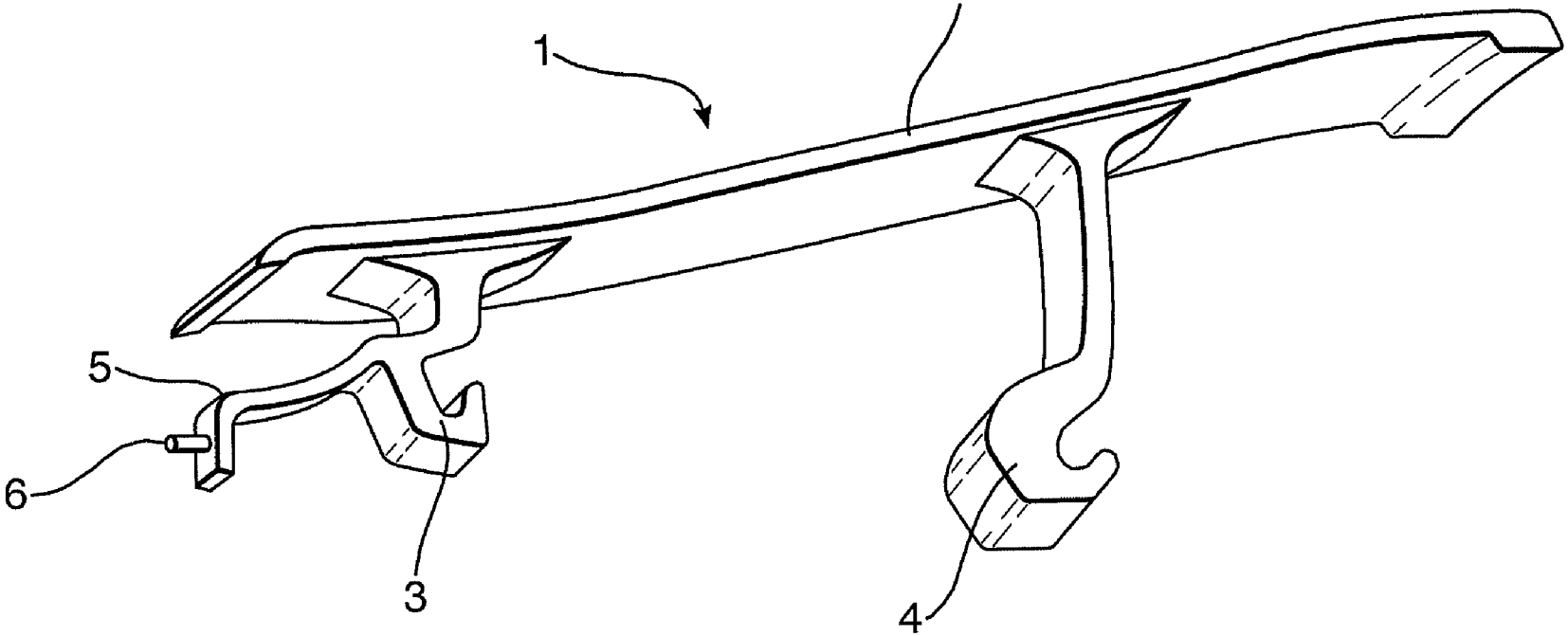
Fig.1. (Prior Art)
FIG. 1 shows a side perspective view of a conventional annulus filler.
Figure 2:
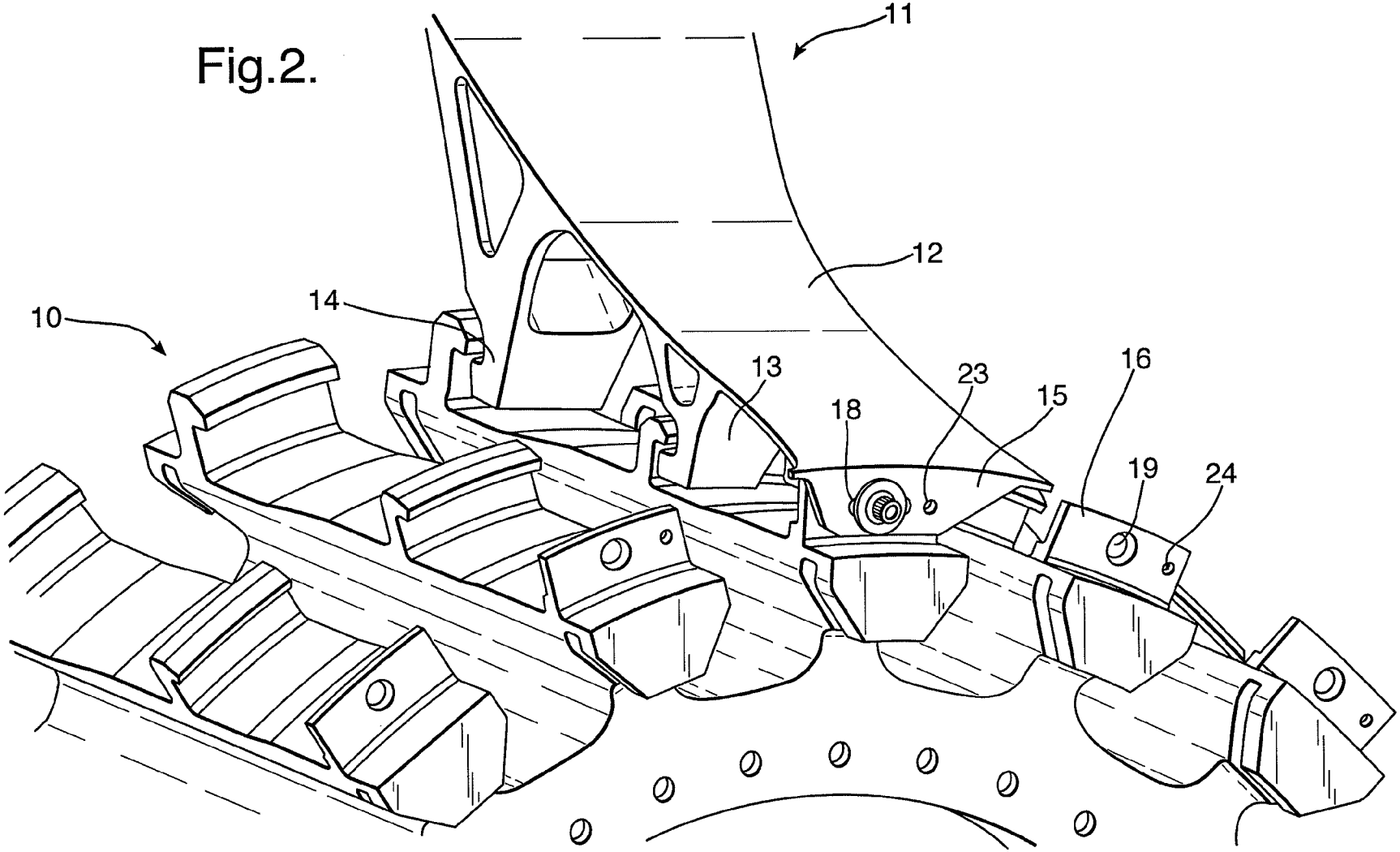
FIG. 2 shows a front perspective view of an annulus filler according to the present invention.

FIG. 2 shows a front perspective view of an annulus filler 11 according to the present invention. Like the conventional filler of FIG. 1, it has a lid 12 for bridging the gap between two adjacent fan blades (not shown) and defining the inner wall of the flow annulus of a fan stage. The filler 11 is mounted on a fan disc 10 by forward and rearward hooks 13, 14. These form the primary connectors for the filler, joining to correspondingly-shaped hooks on the outer radial surface of the disc to resist, in use, centrifugal forces on the filler and motion of the filler in the rearwards axial direction.

The contacting faces of the hooks 13, 14 and correspondingly-shaped hooks of the disc 10 are curved around radii to the engine centre-line, allowing the filler to slide circumferentially at the contacting faces when the filler is exposed to lateral forces from the adjacent blades.

The filler 11 is also attached to a front fixing plate 16 of the disc 10 at axial retention flange 15 by fixing bolt 17 which extends through a slot 18 in the retention flange and a hole 19 in the fixing plate. The retention flange and fixing bolt form a secondary connector for the filler which, in use, resists motion of the filler in the forwards axial direction.

To mount the filler 11 to the disc, the filler is inserted into the space between two adjacent blades along a forward to rearward direction, until hooks 13, 14 engage with their respective correspondingly-shaped hooks on the disc. The circumferential position of the filler is adjusted so that its centre of gravity is on a radius from the engine centre-line passing through the bolt 17. To assist with this adjustment, flange 15 and plate 16 have respective holes 23, 24 which, when aligned, indicate the correct circumferential position. A close fit pin is inserted through the alignment holes 23, 24. Fixing bolt 17 is then inserted through slot 18 and hole 19. The bolt 17 is tightened and the close fit pin removed.

The close fit pin (not shown) is preferably hollow or shaped so that it is easily broken. A frangible close fit pin is preferred so that in the event it is inadvertently left in the alignment holes 23,24 it is not deleterious to the operation of the annulus filler.

If the filler centre of gravity is not aligned during mounting, at high rotational speeds the filler will tend to rotate about the engine centre-line until alignment is achieved. However, other means of aligning the filler and the rotor, such as alignment datums or surfaces, can be used instead of holes 23, 24. Alternatively, an assembly jig may ensure alignment. Indeed, the filler can be self-aligning under rotation, which avoids the need for the adjustment step of the mounting procedure.

Figure 3A:
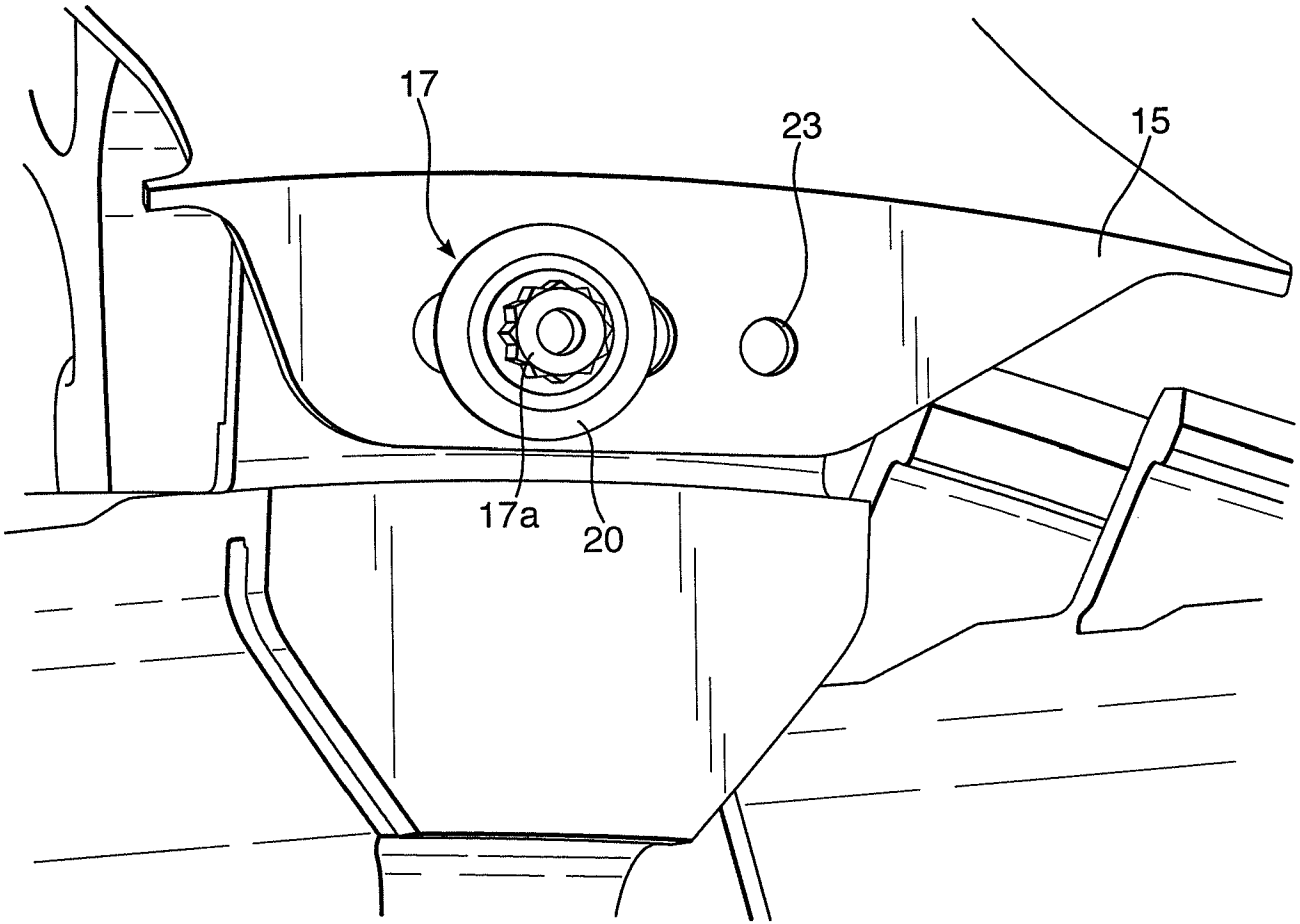
FIGS. 3*a* and *b* are close-up views of the axial retention flange of the filler of FIG. 2 respectively with and without a fixing bolt.
Figure 3B:
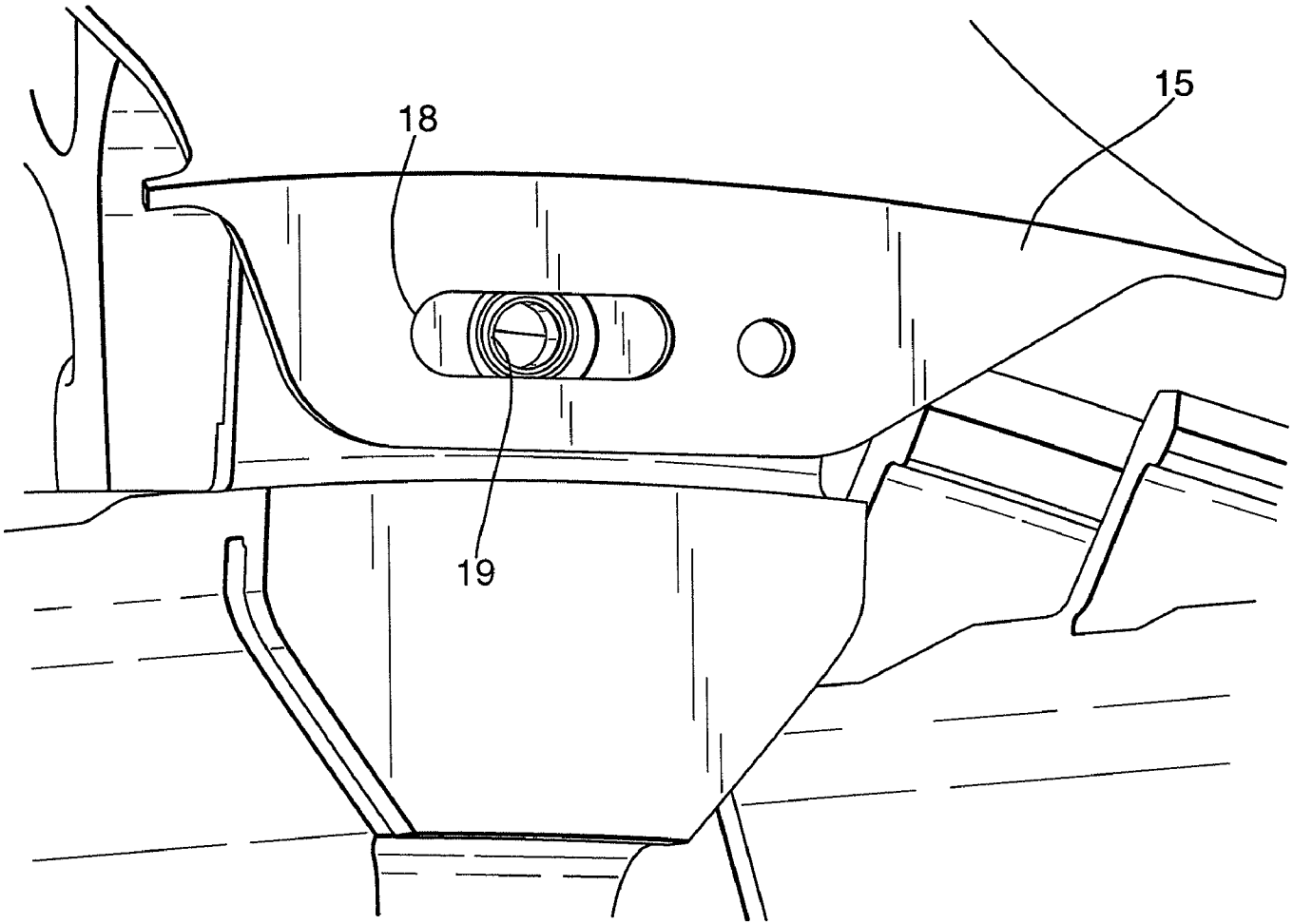
Figure 4:
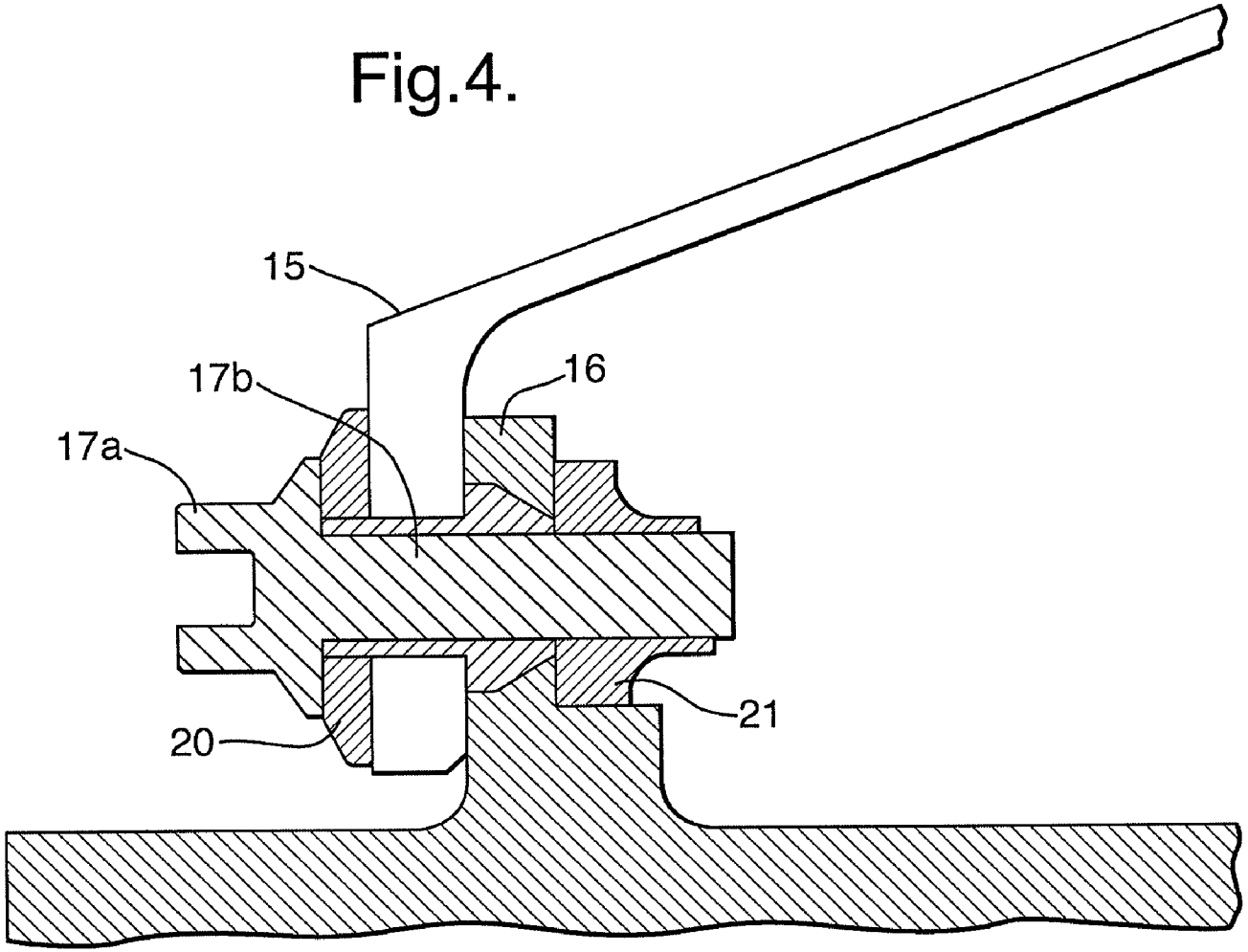
FIG. 4 shows the retention flange and fixing bolt of FIG. 3 in cross-section.

FIG. 3*a* is a close-up view of the retention flange 15 and the fixing bolt 17, and FIG. 3*b* is the same close-up view but without the fixing bolt to better show the slot 18 and the hole 19. FIG. 4 shows the retention flange 15 and fixing bolt 17 in cross-section.

The head 17*a* of the bolt 17 sits on a spreader washer 20 to distribute the load at the bolt head. The interfaces between the flange 15 and plate 16, and between the flange 15 and the washer 20 are lubricated to reduce friction at these interfaces when the filler rotates. A swaged nut 21 retained at hole 19 is threaded to the shaft 17*b* of the bolt 17 to tighten the bolt.

Figure 5A:
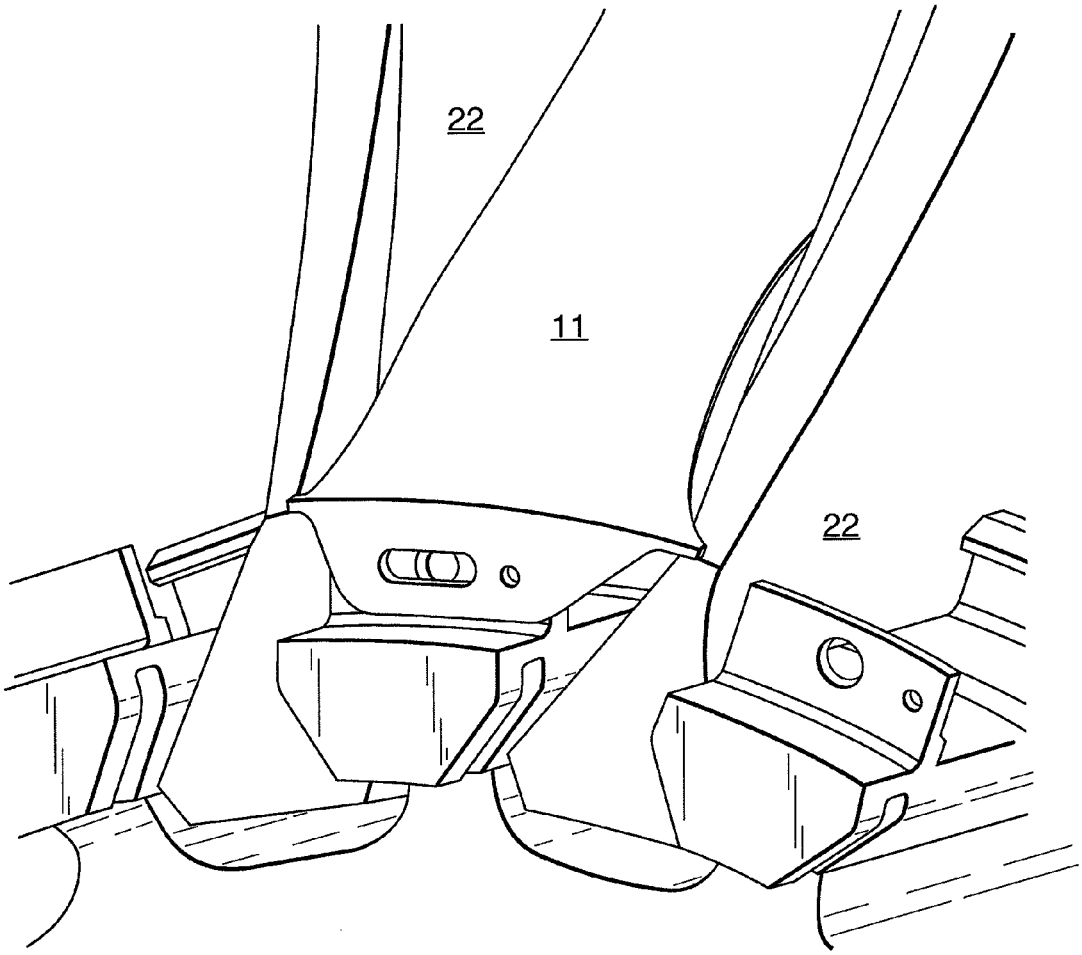
FIGS. 5*a* and *b* show the filler of FIG. 2 and adjacent blades in respectively their assembly positions and rotated positions.
Figure 5B:
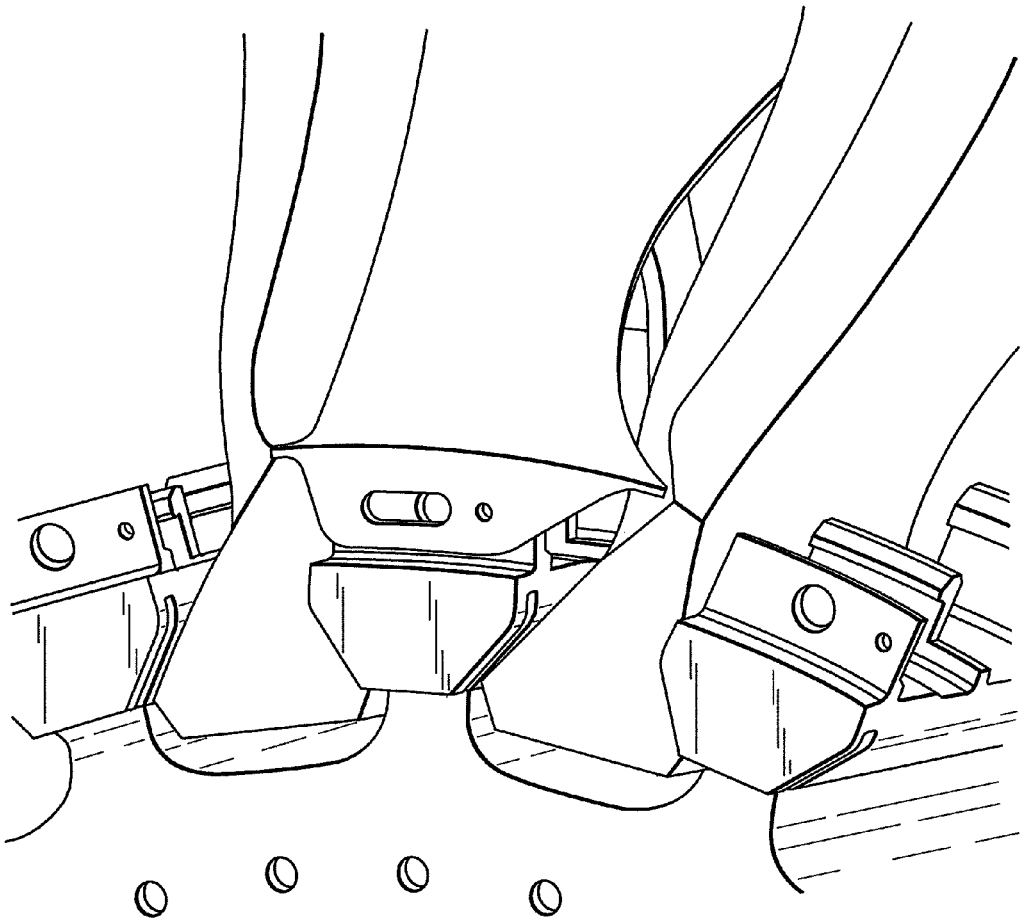

The shaft 17*b* of the bolt 17 serves as a pin extending though the slot 18. When the filler is exposed to a lateral force from an adjacent blade, the shaft can move along the slot until it impinges on the end of the slot, thereby allowing the filler to rotate by a limited amount at the secondary connector. This rotation, which occurs with the rotation at the primary connectors, can prevent potentially damaging twisting forces from being applied to the filler. The slot length can therefore be configured to correspond to the predicted amount of deflection that the blades experience under birdstrike or blade-off events. FIGS. 5*a* and *b* show the filler 11 and adjacent blades 22 in respectively their assembly positions and rotated positions after such an event. To better show the relative positions of the slot 18 and hole 19, the fixing bolt 17 is omitted.

In FIG. 3*a*, the fixing bolt 17 is shown centred in the slot 18 in the assembly position. It is generally found, however, that annulus fillers tend to rotate in only one direction on birdstrike or blade-off events. Thus, the slot position on retention flange 15 may be altered to locate the bolt towards one end of the slot in the assembly position.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An annulus filler for mounting to a rotor disc of a gas turbine engine and for bridging a gap between two adjacent blades attached to the rotor disc, the annulus filler defining an airflow surface for air being drawn through the engine, the annulus filler comprising:

one or more primary connectors for connecting the annulus filler to the rotor disc, and for resisting, in use, centrifugal forces on the annulus filler, each of the one or more primary connectors allowing rotation of the annulus filler around a centre line of the engine relative to the rotor disc at that primary connector; and a secondary connector formed at an axial end of the annulus filler for connecting the annulus filler to the rotor disc and for resisting, in use, motion of the annulus filler relative to the rotor disc in a first axial direction, the secondary connector allowing rotation of the annulus filler around the centre line of the engine relative to the rotor disc at the secondary connector.

2. An annulus filler according to claim 1, wherein each of the one or more primary connectors further comprises a hook extending radially inwards for engagement with a correspondingly-shaped hook on the radially outer face of the rotor disc.

3. An annulus filler according to claim 1, wherein each of the one or more primary connectors further comprises a means to resist, in use, motion of the annulus filler relative to the rotor disc in an axial direction opposite the first axial direction.

4. An annulus filler according to claim 1, wherein the secondary connector further comprises a pin and slot coupling, the slot extending in a circumferential direction, and the pin extending through the slot in an axial direction and being movable along the slot to allow the rotation around the centre line at the secondary connector.

5. An annulus filler according to claim 4, wherein the slot is formed in the annulus filler.

6. An annulus filler according to claim 4, wherein the pin is provided by a fixing bolt which, in use, resists the motion of the annulus filler relative to the rotor disc in the first axial direction.

7. An annulus filler according to claim 1, wherein the secondary connector is configured to allow the rotation around the centre line at the secondary connector only within predetermined limits.

8. An annulus filler according to claim 1 in which alignment means are provided to circumferentially align the filler relative to the rotor disc.

9. An annulus filler as claimed in claim 8 in which the alignment means are datum surfaces on the filler and the rotor disc.

10. An annulus filler as claimed in claim 8 in which the alignment means is a frangible pin which extends through the filler and the rotor disc.

11. An annulus filler according to claim 1, wherein the blades are fan blades.

* * * * *